US008771098B2

(12) United States Patent
Hilton

(10) Patent No.: US 8,771,098 B2
(45) Date of Patent: Jul. 8, 2014

(54) MULTIPLE MATERIAL PUTTER

(75) Inventor: Thomas R. Hilton, Cardiff, CA (US)

(73) Assignee: Callaway Golf Company, Carlsbad, CA (US)

( * ) Notice: Subject to any disclaimer, the term of this patent is extended or adjusted under 35 U.S.C. 154(b) by 169 days.

(21) Appl. No.: 13/570,081

(22) Filed: Aug. 8, 2012

(65) Prior Publication Data

US 2014/0045607 A1 Feb. 13, 2014

(51) Int. Cl.
*A63B 69/36* (2006.01)
*A63B 53/04* (2006.01)

(52) U.S. Cl.
USPC ..... 473/251; 473/332; 473/334; 473/340; 473/349

(58) Field of Classification Search
CPC ..... A63B 53/007; A63B 53/0487; A63B 53/065; A63B 2053/0491
USPC ..... 473/332, 339–341, 349, 251–256, 334
See application file for complete search history.

(56) References Cited

U.S. PATENT DOCUMENTS

| | | | | | |
|---|---|---|---|---|---|
| 6,001,030 | A * | 12/1999 | Delaney | 473/329 |
| D426,599 | S * | 6/2000 | Morgan et al. | D21/736 |
| 6,095,931 | A * | 8/2000 | Hettinger et al. | 473/341 |
| 6,328,661 | B1 * | 12/2001 | Helmstetter et al. | 473/324 |
| 6,478,690 | B2 * | 11/2002 | Helmstetter et al. | 473/324 |
| 6,478,694 | B2 * | 11/2002 | Anderson et al. | 473/350 |
| 6,663,502 | B2 * | 12/2003 | Nelson et al. | 473/324 |
| 6,743,112 | B2 * | 6/2004 | Nelson | 473/251 |
| 7,473,186 | B2 * | 1/2009 | Best et al. | 473/329 |
| 8,523,698 | B2 * | 9/2013 | Hotaling et al. | 473/251 |
| 2004/0058743 | A1 * | 3/2004 | Hettinger et al. | 473/340 |
| 2013/0137533 | A1 * | 5/2013 | Franklin et al. | 473/349 |

* cited by examiner

*Primary Examiner* — Sebastiano Passaniti
(74) *Attorney, Agent, or Firm* — Rebecca Hanovice; Michael A. Catania; Sonia Lari

(57) ABSTRACT

A golf club putter having a low head center of gravity and a high MOI is disclosed herein. The putter has a metal body comprising a face and a hosel, a low density dampening layer affixed to the body, and a high density rear weight affixed to the dampening layer, and the dampening layer has a first surface that forms an angle with an opposing second surface that is inversely proportional to the distance of the hosel from a heel side of the body.

19 Claims, 5 Drawing Sheets

MULTIPLE MATERIAL PUTTER

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a multiple material putter having a high moment of inertia and a low center of gravity.

2. Description of the Related Art

Technical innovation in the size, structure, configuration, material, construction, and performance of golf clubs has resulted in a variety of new products. Most putters are constructed in such a way that the head is made from a single type of parent material, such as steel. There is a need for putters that have increased moments of inertia and low centers of gravity, a combination that is difficult to achieve with current putter configurations currently available on the market.

BRIEF SUMMARY OF THE INVENTION

One aspect of the present invention is a putter comprising a body comprising a face and a hosel, a dampening layer comprising a front surface and a rear surface, and a rear weight, wherein the face comprises a striking surface and a rear surface, wherein the dampening layer is affixed to the rear surface, wherein the rear weight is affixed to the dampening layer, and wherein the front surface is not parallel with the back surface. In some embodiments, the dampening layer may be composed of urethane, the rear weight may be composed of a high density metal alloy, and may include tungsten, and the body may be composed of carbon steel. In some embodiments, the body and the rear weight may each have a dark color, such as black, and the dampening layer may have a light color, such as white. The striking surface may comprise a textured pattern, which may be machined into the striking surface. In one embodiment, the putter may have a moment of inertia of no less than 3200 g-cm$^2$ and no more than 5500 g-cm$^2$.

In some further embodiments, an angle created by the front surface with respect to the rear surface may be inversely proportional to the distance between the hosel and a heel side or a toe side of the putter body. In some of these embodiments, the front surface may be parallel with the rear surface when the hosel is located at a midpoint on the putter body. In other embodiments, the striking surface may be disposed on a face insert, which may be disposed within a recess in the face.

Another aspect of the present invention is a putter comprising a carbon steel body comprising a face, a rear side, a heel side, a toe side, and a hosel disposed proximate the heel side, a urethane dampening layer comprising a first surface and a second surface, and a tungsten alloy rear weight comprising a third surface and a fourth surface, wherein the face comprises a recess sized to receive a face insert, wherein the first surface is affixed to the rear side, wherein the third surface is affixed to the second surface, wherein the first surface forms a first angle with the second surface, wherein the third surface forms a second angle with the fourth surface, and wherein the first angle and the second angle add up to 90°. In some embodiments, the first angle may be no less than 1° and no greater than 45°. In other embodiments, the dampening layer and the rear weight may be removably affixed to the body with one or more fasteners. In alternative embodiments, the dampening layer and the rear weight may be permanently affixed to the body.

Yet another aspect of the present invention is a putter comprising a metal body comprising a face, a rear side, a heel side, a toe side, and a hosel, a low density dampening layer comprising a first surface and a second surface, and a high density rear weight, wherein the first surface is affixed to the rear side, wherein the first surface forms a first angle with the second surface, wherein the first angle is greater than 0° and less than 90°, wherein the magnitude of the first angle is inversely proportional to a distance between the hosel and a heel side or a toe side of the putter body, wherein the body and the rear weight each have a first color, and wherein the dampening layer has a contrasting second color, and wherein the putter has a moment of inertia of no less than 3200 g-cm$^2$ and no more than 5500 g-cm$^2$. In some embodiments, the first color may be black and the second color may be white. In other embodiments, the first angle may be approximately 20°.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The golf club head of the present invention includes a multiple material construction with a middle layer having an angled configuration that ensures a low, rearwardly located center of gravity. The golf club head also includes a rear weight to create a high moment of inertia around a vertical axis.

Figure 1:
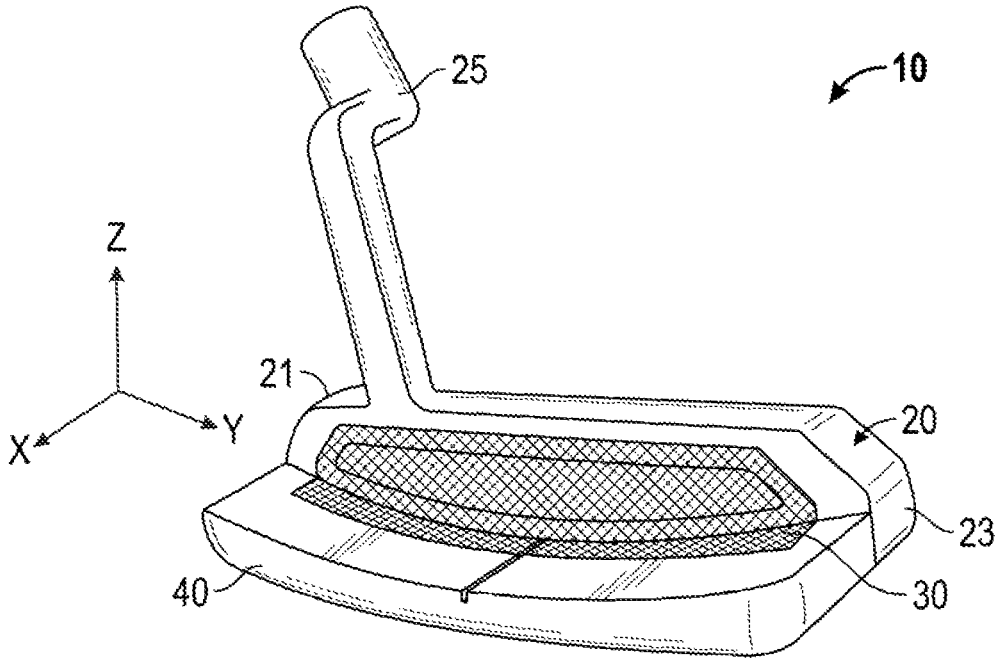
FIG. 1 is a back perspective view of a first embodiment of the present invention.
Figure 2:
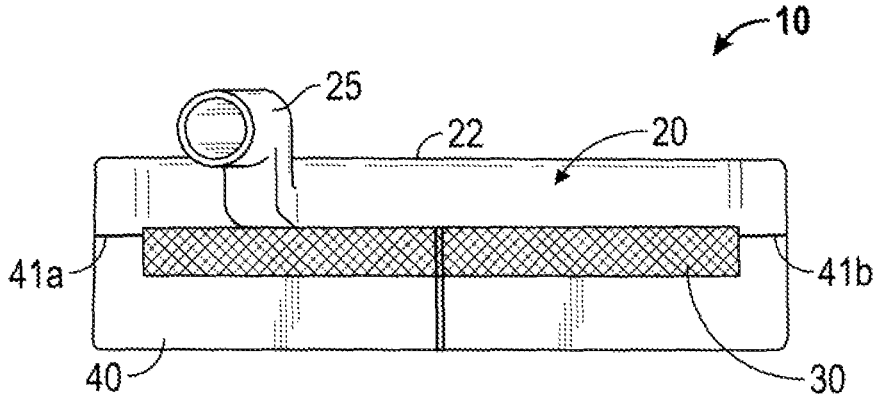
FIG. 2 is a top plan view of the embodiment shown in FIG. 1.
Figure 3:
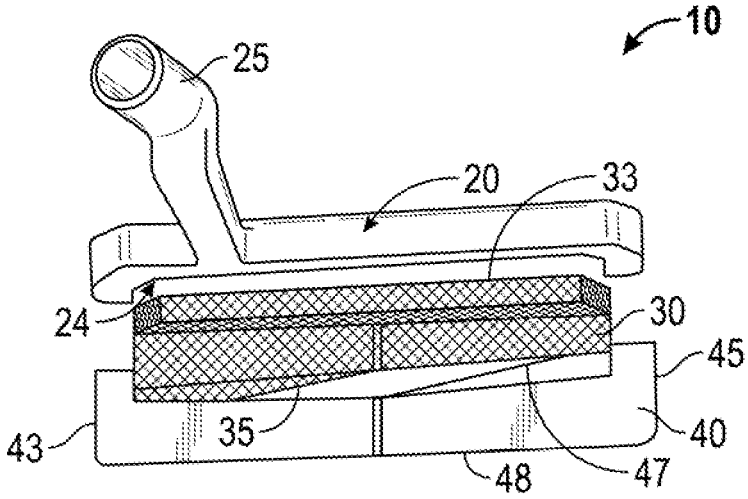
FIG. 3 is a top, exploded view of the embodiment shown in FIG. 1.
Figure 4:
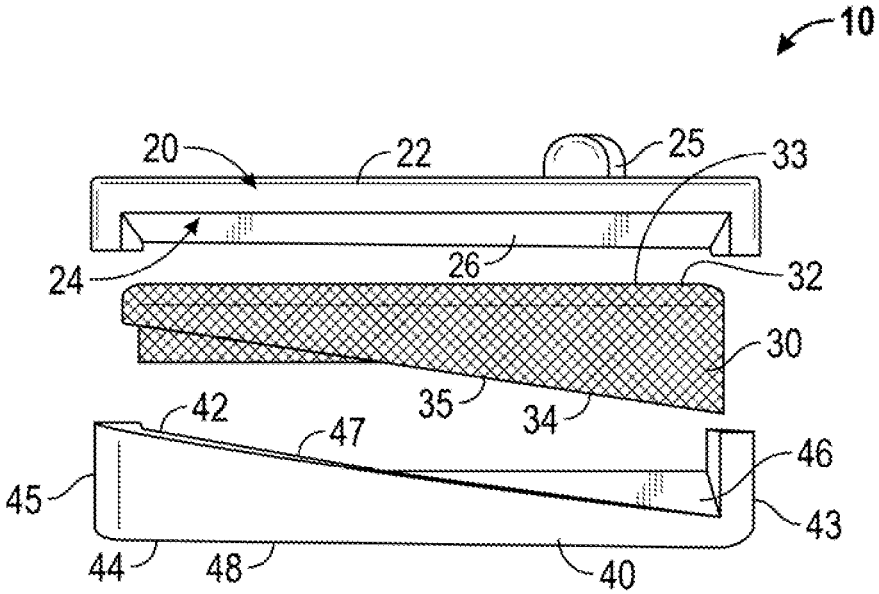
FIG. 4 is a bottom, exploded view of the embodiment shown in FIG. 1.
Figure 5:
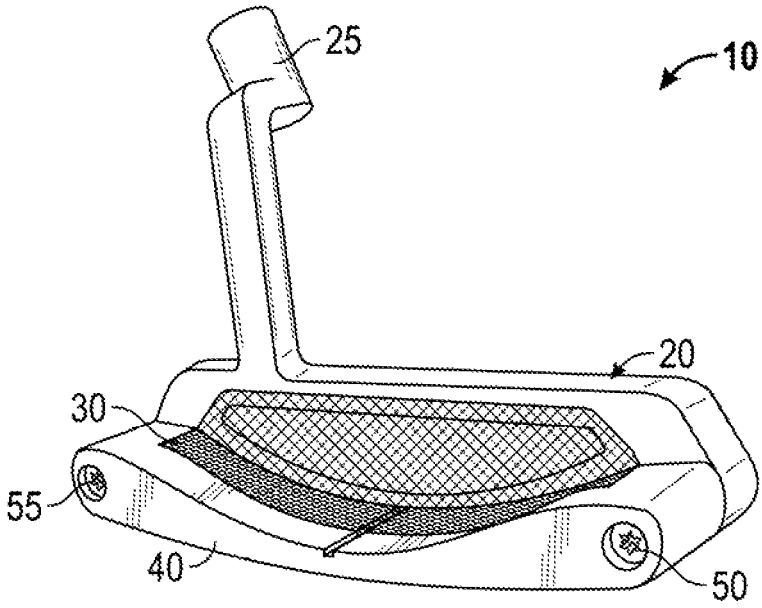
FIG. 5 is a back perspective view of a second embodiment of the present invention.
Figure 6:
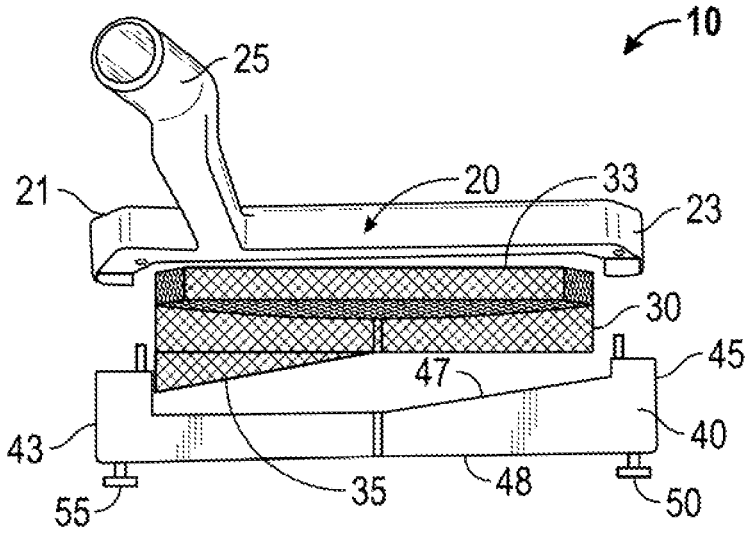
FIG. 6 is a top exploded view of the embodiment shown in FIG. 5.
Figure 7:
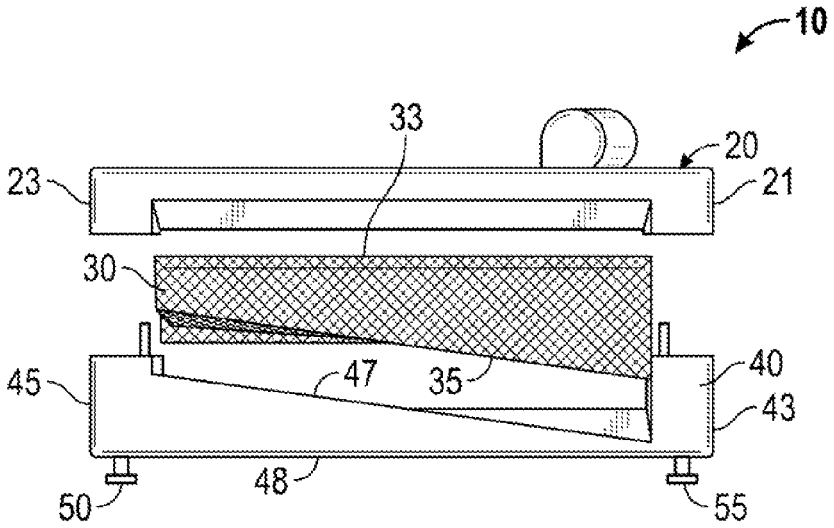
FIG. 7 is a bottom exploded view of the embodiment shown in FIG. 5.

A preferred embodiment of the present invention is shown in FIGS. 1-4. In this embodiment, the putter head 10 includes an integrally formed body 20, which preferably is formed from carbon steel, including a face 22 and a hosel 25. The hosel 25 is located proximate a heel 21 of the body 20, and represents a significant portion of the overall mass of the putter head 10. The putter head 10 also includes a dampening layer 30, preferably is formed from a polymer such as urethane, which is affixed to a rear portion 24 of the body 20. As shown in FIG. 4, the rear portion 24 preferably includes a recess 26 sized to receive a front portion 32 of the dampening layer 30 so that the dampening layer 30 nests within the body 20.

The putter head 10 also includes a rear weight 40, which preferably comprises tungsten, having a front portion 42 that is affixed to a rear portion 34 of the dampening layer 30 and, as shown in FIGS. 1-4, makes contact with the rear portion 24 of the body 20 at two contact points 41*a*, 41*b*. The front portion 42 of the rear weight 40 preferably includes a recess 46 into which the rear portion 34 of the dampening layer 30 fits. The rear weight 40 also includes a rear portion 44 that, in the preferred embodiment, has a rear surface 48 that is parallel to the face 22 of the body 20, though in alternative embodiments the rear surface 48 of the rear weight 40 may form any angle with the face 22. In this preferred embodiment, the rear weight 40 is at least 100 and no more than 200 grams, more preferably approximately 160 grams, and provides the putter head 10 with a moment of inertia around a vertical Z axis of at least 3200 g-cm$^2$, more preferably at least 4000 g-cm$^2$, and most preferably approximately 5000 to 5500 g-cm$^2$.

The putter head 10 of the preferred embodiment preferably is assembled as shown in FIG. 4, and the pieces are fixed in place by brazing the rear portion 24 of the body 20 to the front portion 42 of the rear weight 40 at the two contact points 41*a*, 41*b*, thus securely fixing the dampening layer 30 between the body 20 and the rear weight 40. The body 20 may, in alternative embodiments, be welded or soldered to the rear weight 40. In one alternative embodiment, shown in FIGS. 5-9, the body 20 is affixed to the rear weight 40 with fasteners 50, 55 that are inserted into bores located at heel 21, 43 and toe 23, 45 ends of each of the body 20 and rear weight 40. In this customizable embodiment, the body 20, dampening layer 30, and/or rear weight 40 may be replaced with pieces haying different characteristics, including different weights, materials, and shapes. The fasteners 50, 55 also may be selected according to weight, density, and/or material composition to affect overall weight, moment of inertia, and/or the location of the center of gravity of the putter head 10.

In each of the embodiments of the present invention, the front portion 32 of the dampening layer 30 comprises a front surface 33 that is not parallel with a rear surface 35 disposed on the rear portion 34 of the dampening layer 30. Similarly, the front portion 42 of the rear weight 40 includes a front surface 47 that is not parallel with a rear surface 48 disposed on the rear portion 44 of the rear weight 40. The front surface 33 of the dampening layer 30 preferably forms an angle X of 1-45° with the rear surface 35, while the front surface 47 of the rear weight preferably forms angle Y with the rear surface 48, such that X+Y=90° as shown in FIGS. 10A-10D. This angular configuration is desirable because the rear surface 48 of the rear weight 40 preferably is parallel to the face 22 of the body 70.

Figure 8:
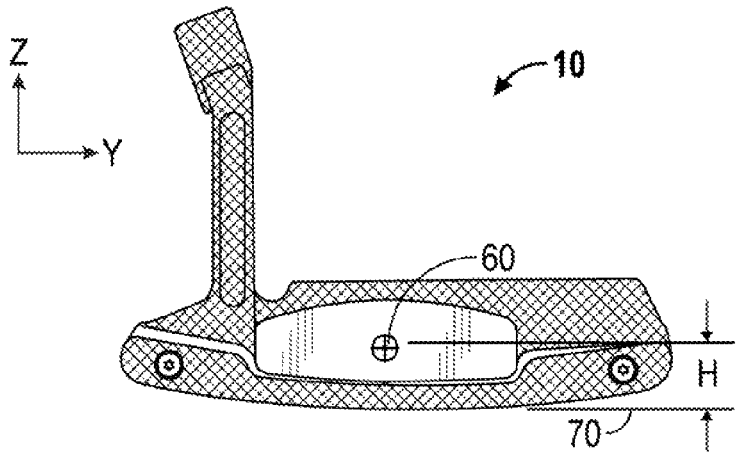
FIG. 8 is a rear plan view of a variation of the embodiment shown in FIG. 5.
Figure 9:
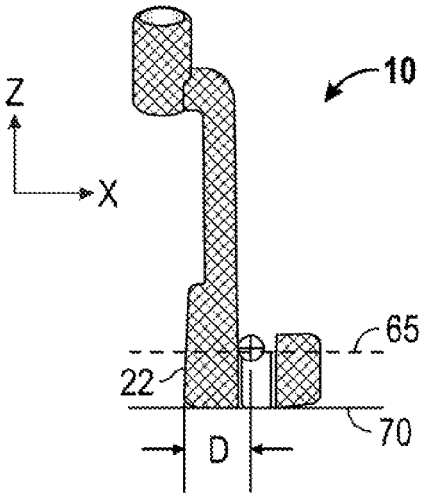
FIG. 9 is a side plan view of a variation of the embodiment shown in FIG. 5.
Figure 10A:
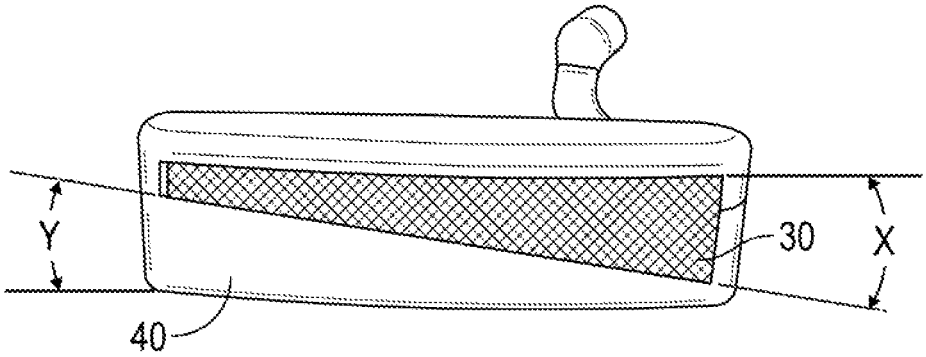
FIG. 10A is a bottom perspective view of the first embodiment of the present invention.
Figure 10B:
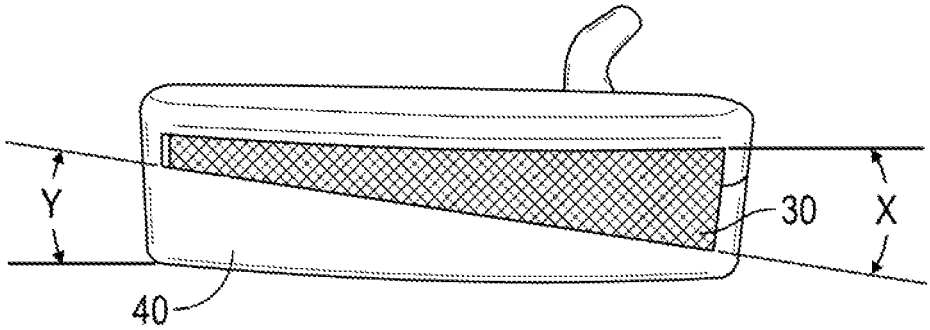
FIG. 10B is a bottom perspective view of a third embodiment of the present invention.
Figure 10C:
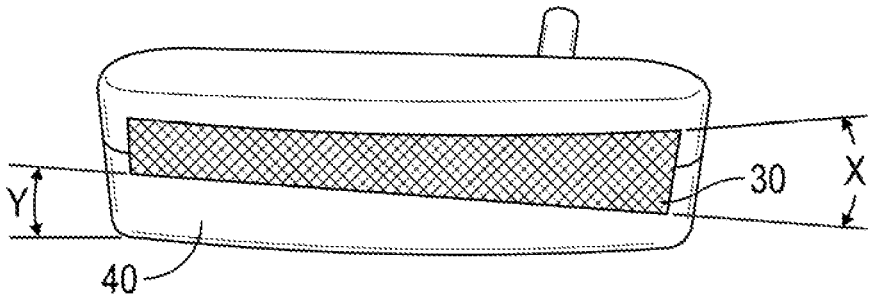
FIG. 10C is a bottom perspective view of a fourth embodiment of the present invention.
Figure 10D:
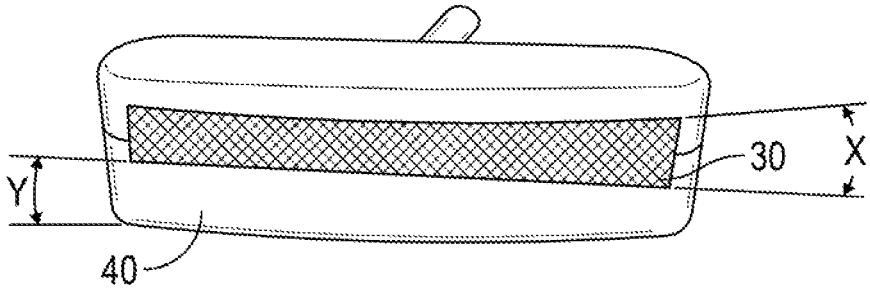
FIG. 10D is a bottom perspective view of a fifth embodiment of the present invention.

The center of gravity (CG) 60 of the putter head 10 of the present invention preferably is located on an X axis 65 intersecting the geometric center of the club face that is parallel with the ground plane 70 as shown in FIGS. 8 and 9. This location determines the height H of the CG, as the geometric face center is located a specified distance above the ground plane 70 along a vertical Z axis that is perpendicular to the ground plane 70. The CG 60 may be located as close to the ground plane 70 as possible along the vertical Z axis, and is also is preferably located as far away from the face 22 towards the rear weight 40 along the X axis 65 as possible. As shown in FIGS. 10A-10D, angles X and Y of the dampening layer 30 and the rear weight 40 preferably change depending on the distance of the hosel 25 from the heel 21 or the toe 23, and on the overall weight and shape of the hosel 25, to ensure that the CG 60 maintains its preferred location, and the height H and depth D measurements, along the geometric center axis 65. In particular, the magnitude of angle X is inversely related to the distance between the hosel 25 and the heel 21; as the distance between the hosel 25 and the heel 21 increases, the angle X gets smaller. As shown in FIGS. 10A-10D, this relationship allows the structure and/or overall shape of the putter head 10 to change without affecting the desired CG 60 location.

The putter heads 10 of the present invention also preferably include contrasting color patterns that function as alignment aids. As shown in FIGS. 1-7 and 10A-D, the body 20 and the rear weight 40 are each a light color, preferably white, while the dampening layer 30 is a contrasting dark color, preferably black. As shown in FIGS. 8 and 9, this color configuration may be reversed, with the dampening layer 30 having a light color and the body 20 and rear weight 40 having a darker, contrasting color.

The face 22 of each of the putter heads 10 disclosed herein may include a recessed portion (not shown) sized to receive a face insert (not shown), or may be integrally formed. The face 22 itself, whether integrally formed or created with a face insert, preferably includes texturing, which may be integrally formed with a mold or casting or may be added after formation by machining or milling.

The body, dampening layer, and rear weight of each of the putters of the present invention may be composed of any number of materials known in the art, such as metal alloys, polymers, and composites, and including those materials disclosed in U.S. Pat. Nos. 6,328,661 and 6,478,690, the disclosure of each of which is hereby incorporated by reference in its entirety herein. The putters of the present invention may also take any shape or general structure known in the art.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A putter comprising:

a body comprising a face and a hosel;

a dampening layer comprising a first front surface and a first rear surface; and a rear weight comprising a second front surface and a second rear surface, wherein the face comprises a striking surface and a third rear surface, wherein the dampening layer is affixed to the third rear surface, wherein the rear weight is affixed to the dampening layer, wherein the second front surface comprises a recess sized to receive a portion of the dampening layer, wherein a portion of the dampening layer is disposed within the recess, and wherein the first front surface is not parallel with the first rear surface.

2. The putter of claim 1, wherein the dampening layer is composed of urethane.

3. The putter of claim 1, wherein the rear weight is composed of a high density metal alloy.

4. The putter of claim 1, wherein the rear weight comprises tungsten.

5. The putter of claim 1, wherein the body is composed of carbon steel.

6. The putter of claim 1, wherein the body and the rear weight each have a dark color, and wherein the dampening layer has a light color.

7. The putter of claim 6, wherein the dark color is black, and wherein the light color is white.

8. The putter of claim 1, wherein the striking surface comprises a textured pattern.

9. The putter of claim 8, wherein the textured pattern is machined into the striking surface.

10. The putter of claim 1, wherein the putter has a moment of inertia of no less than 3200 g-cm$^2$ and no more than 5500 g-cm$^2$.

11. The putter of claim 1, wherein an angle created by the first front surface with respect to the first rear surface is inversely proportional to the distance between the hosel and a heel side or a toe side of the putter body.

12. The putter of claim 1, wherein the striking surface is disposed on a face insert, and wherein the face insert is disposed within a recess in the face.

13. A putter comprising:

a carbon steel body comprising a face, a rear side, a heel side, a toe side, and a hosel disposed proximate the heel side;

a urethane dampening layer comprising a first surface and a second surface; and a tungsten alloy rear weight comprising a third surface and a fourth surface, wherein the face comprises a recess sized to receive a face insert, wherein a portion of the dampening layer has an approximately triangular shape, wherein the first surface is affixed to the rear side, wherein the third surface is affixed to the second surface, wherein the first surface forms a first angle with the second surface, wherein the third surface forms a second angle with the fourth surface, and wherein the first angle and the second angle add up to 90°.

14. The putter of claim 13, wherein the first angle is no less than 1° and no greater than 45°.

15. The putter of claim 13, wherein the dampening layer and the rear weight are removably affixed to the body with one or more fasteners.

16. The putter of claim 13, wherein the dampening layer and the rear weight are permanently affixed to the body.

17. A putter comprising:

a metal body comprising a face, a rear side, a heel side, a toe side, and a hosel;

a low density dampening layer comprising a first surface and a second surface; and a high density rear weight comprising a recess, wherein a portion of the dampening layer is disposed within the recess, wherein the first surface is affixed to the rear side, wherein the first surface forms a first angle with the second surface, wherein the first angle is greater than 0° and less than 90°, wherein the magnitude of the first angle is inversely proportional to a distance between the hosel and a heel side or a toe side of the putter body, wherein the body and the rear weight each have a first color, and wherein the dampening layer has a contrasting second color, and wherein the putter has a moment of inertia of no less than 3200 g-cm$^2$ and no more than 5500 g-cm$^2$.

18. The putter of claim 17, wherein the first color is black and the second color is white.

19. The putter of claim 17, wherein the first angle is approximately 20°.

* * * * *